US009359978B2

(12) United States Patent
Balsdon et al.

(10) Patent No.: US 9,359,978 B2
(45) Date of Patent: Jun. 7, 2016

(54) TURBO PURGE MODULE HOSE DETECTION AND BLOW OFF PREVENTION CHECK VALVE

(71) Applicant: Continental Automotive Systems, Inc., Auburn Hills, MI (US)

(72) Inventors: David W Balsdon, Chatham (CA); Allen Tamman, Chatham (CA)

(73) Assignee: Continental Automotive Systems, Inc., Auburn Hills, MI (US)

( * ) Notice: Subject to any disclaimer, the term of this patent is extended or adjusted under 35 U.S.C. 154(b) by 191 days.

(21) Appl. No.: 14/224,438

(22) Filed: Mar. 25, 2014

(65) Prior Publication Data

US 2015/0275826 A1 Oct. 1, 2015

(51) Int. Cl.
*F02M 33/02* (2006.01)
*F02M 25/08* (2006.01)

(52) U.S. Cl.
CPC ..... *F02M 25/0872* (2013.01); *F02M 25/0836* (2013.01)

(58) Field of Classification Search
CPC . F02M 25/0836; F02M 25/089; F02M 25/08; F02M 25/0872; F02D 41/004; F02D 41/003; F02D 41/0032; F02D 41/062
See application file for complete search history.

(56) References Cited

U.S. PATENT DOCUMENTS 3,288,578 A * 11/1966 Witt ..... F16K 17/19 137/467
3,617,034 A * 11/1971 Skinner ..... B60K 15/03504 123/518
3,824,792 A * 7/1974 Grabb ..... B60T 13/52 417/395
4,026,258 A * 5/1977 Ino ..... F01L 13/00 123/520
4,168,686 A * 9/1979 Wakita ..... F02M 25/089 123/521
4,530,210 A * 7/1985 Yamazaki ..... F02B 33/44 123/520
4,557,226 A * 12/1985 Mayer ..... F01M 13/00 123/41.86
4,658,798 A * 4/1987 Yogo ..... F02D 23/00 123/437
5,544,483 A * 8/1996 Heuer ..... F01N 3/2033 60/283
5,918,580 A * 7/1999 Hennrich ..... F02M 25/089 123/516
6,446,618 B1 * 9/2002 Hill ..... F02M 25/089 123/519
6,625,981 B2 * 9/2003 Ikeda ..... B60T 13/52 60/397
7,367,326 B2 * 5/2008 Shikama ..... F02M 25/0809 123/198 D
7,373,930 B1 * 5/2008 Hadre ..... F02M 25/0836 123/198 D (Continued)

*Primary Examiner* — Marguerite McMahon
*Assistant Examiner* — Tea Holbrook

(57) ABSTRACT

A valve assembly used as part of a vapor purge system, which uses a vacuum created by a venturi nozzle to direct purge vapor from a canister through the purge system, and into an intake manifold. The valve assembly includes a check valve which closes the flow path to prevent the uncontrolled venting of hydrocarbon rich purge vapor directly to the atmosphere, and provides an on-board diagnostic (OBD) check to make sure the system is functioning properly. The check valve is typically open because of a pressure balance around the check valve, allowing the turbo bleed flow, as well as the purge vapor, to pass through the check valve and into an air box. If the hose is disconnected, there is a pressure drop across the valve, which causes the check valve to close, preventing the release of hydrocarbons in the purge vapor to the atmosphere.

20 Claims, 1 Drawing Sheet

(56) References Cited

U.S. PATENT DOCUMENTS 7,634,348 B2 * 12/2009 Hirooka ..... B60K 6/48 701/103
8,924,133 B2 * 12/2014 Hadre ..... F02M 25/0809 123/520
9,109,550 B2 * 8/2015 Kempf ..... F02M 25/0836
2012/0247432 A1 * 10/2012 Cardno ..... F02M 25/0872 123/518
2013/0008413 A1 * 1/2013 Inoguchi ..... F02M 25/0836 123/518
2013/0019844 A1 * 1/2013 Kulkarni ..... B60K 15/03504 123/520
2013/0220282 A1 * 8/2013 Hadre ..... F02M 25/0809 123/520
2014/0026865 A1 * 1/2014 Dudar ..... F02M 25/0818 123/518
2014/0196694 A1 * 7/2014 Euliss ..... F02M 25/08 123/520
2014/0311602 A1 * 10/2014 Jefford ..... F16K 15/186 137/899
2014/0345573 A1 * 11/2014 Jefford ..... F02M 25/0836 123/519
2015/0096541 A1 * 4/2015 Edmund ..... F02M 25/0872 123/520
2015/0176542 A1 * 6/2015 Balsdon ..... F02M 25/0836 137/888
2015/0275826 A1 * 10/2015 Balsdon ..... F02M 25/0836 123/518

* cited by examiner

FIG. 1
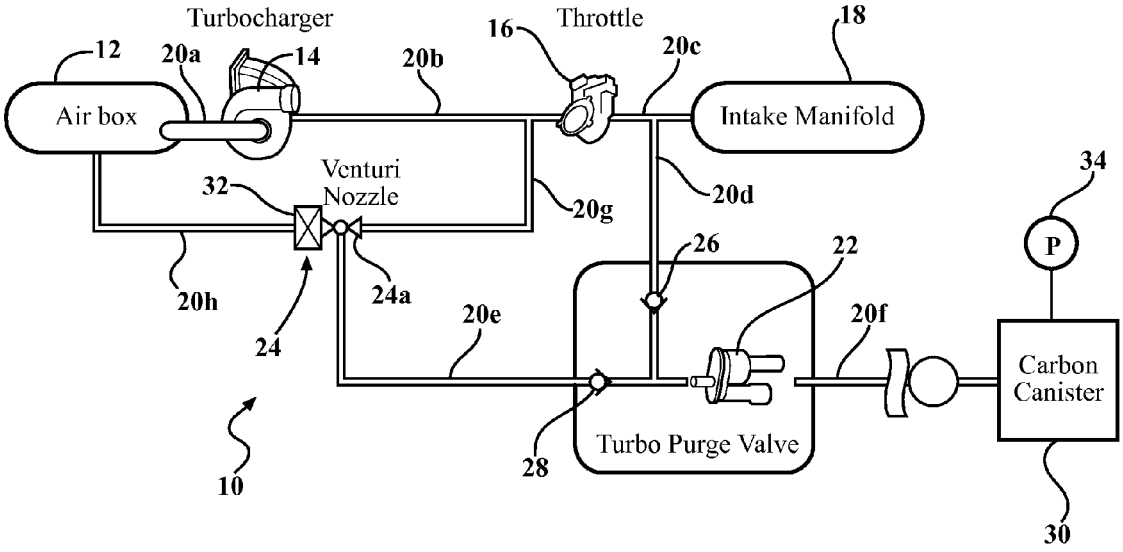
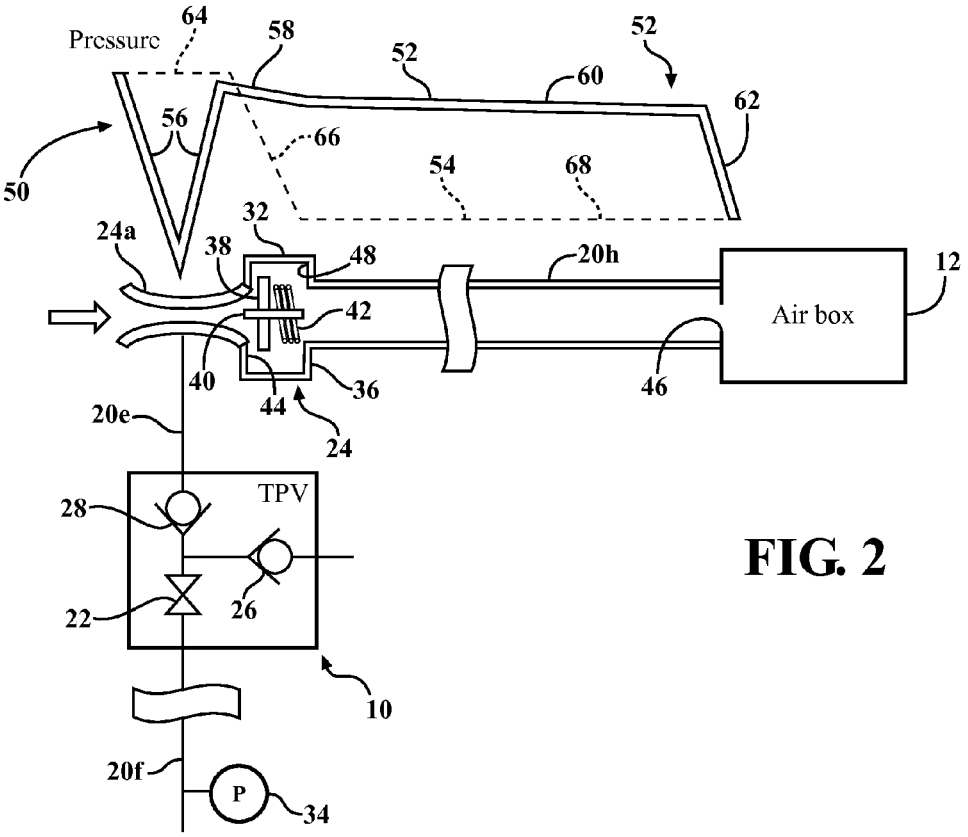
FIG. 2

TURBO PURGE MODULE HOSE DETECTION AND BLOW OFF PREVENTION CHECK VALVE

FIELD OF THE INVENTION

The invention relates generally to an on-board diagnostic feature in an air flow system of a vehicle which also prevents the undesired release of fuel vapors into the atmosphere.

BACKGROUND OF THE INVENTION

Turbochargers are commonly used to increase the power of a vehicle engine. Turbochargers include a turbine which generates pressurized air, and the air is forced into the engine to increase combustion pressure, and therefore increase the power generated by the engine.

With some tubocharging systems, a portion of the pressurized air is bled off to create a vacuum and induce the flow of purge vapor. The vacuum created is used as part of a purge system, where the purge system directs purge vapors from a fuel tank through various conduits to redirect the vapors into the intake manifold of the engine, and burn off these vapors through combustion.

Some turbo purge systems use a venturi vacuum generator (such as a vacuum pump) to allow purge of the evaporative system while the turbocharger is activated (i.e., the intake manifold is under positive pressure). In typical systems, some of the pressure created by the turbo is bled off, through a venturi, which creates the vacuum needed in the venturi to induce purge vapor flow. These venturi nozzles typically are connected to the air intake box through the use of a hose, through which flows the turbo bleed flow, and the hydrocarbon rich, purge vapor. If this hose becomes detached from the air intake box, this could result in blowing hydrocarbons into the atmosphere under the hood of the car.

There are a number of systems currently in production that are potentially non-compliance in terms of having the ability to be able to detect a hose-off condition. Attempts have been made to address this issue by putting the entire vacuum generating venturi into the air box. Other solutions have included adding pressure transducers to the line. Both of these approaches involve additional cost, and may not completely solve the problem.

Accordingly, there exists a need for the prevention of the release of hydrocarbon rich purge vapor in an air flow system when one of the hoses becomes disconnected.

SUMMARY OF THE INVENTION

The present invention is a valve assembly used as part of a vapor purge system, which uses a vacuum created by a venturi nozzle to direct purge vapor from a canister through the purge system, and into an intake manifold. The valve assembly includes a check valve which closes the flow path to prevent the uncontrolled venting of hydrocarbon rich purge vapor directly to the atmosphere, and provides an on-board diagnostic (OBD) check to make sure the system is functioning properly.

During typical operation, the check valve is normally open because of a pressure balance around the check valve, allowing the turbo bleed flow, as well as the purge vapor, to pass through the check valve and into the air box. If the hose is not connected, there is a pressure drop across the valve, and the drop in pressure causes the check valve to close, preventing the venting of hydrocarbons in the purge vapor to the atmosphere. The restricted turbo bleed flow no longer creates a vacuum, and when a purge cycle is commanded, the pressure transducer on the tank then detects that no purge is occurring, indicating a malfunction. This is used to set a malfunctioning light, to indicate that there is a problem.

The valve assembly of the present invention allows the purge valve and vacuum venturi to be modularized. This eliminates hoses, improves packaging, and reduces system costs.

Under normal operation, the check valve has a default position, which is an open position, allowing the turbo bleed flow and the purge flow to flow through the check valve and into the hose connecting the check valve to the air box of an engine. There is an orifice, or flow restricting nozzle added to the air box inlet. If the hose connecting the check valve to the air box is disconnected, the change in the pressure drop causes the check valve to close. This stops the turbo bleed flow, and the venturi nozzle no longer provides a vacuum differential to induce purge flow. If the purge valve opens, and a purge is expected, the pressure transducer on the purge line does not detect a drop in pressure, indicating that there is an issue, and a malfunction light may be activated to alert the driver of the vehicle that something is malfunctioning. The check valve therefore prevents an uncontrolled release of hydrocarbon rich air to the atmosphere, and provides an OBD diagnostic test to allow for a validation of the functionality of the system.

In one embodiment, the present invention is a valve assembly which includes a venturi valve member, a check valve connected to the venturi valve member, an air box, and a first conduit in fluid communication with and connected to the air box. A housing is part of the check valve, where the housing is connected to and in fluid communication with the first conduit and the venturi valve member, and a second conduit is also connected to and in fluid communication with the venturi valve member. A valve plate is moveably disposed in the housing, and the valve plate is moveable between a plurality of closed positions and an open position.

A flow restricting nozzle is formed as part of the air box, and in a first mode of operation, pressurized air flows from the venturi valve member through the housing of the check valve, applying pressure to the valve plate such that the valve plate moves to an open position, allowing the pressurized air to flow through the check valve. The check valve remains in the open position because of a pressure balance around the valve plate created by the back pressure generated by the flow restricting nozzle. When the first conduit becomes disconnected from the air box, the pressure balance around the valve plate is removed, and the pressurized air flowing from the venturi nozzle flows into the housing and places the check valve in one of the closed positions, preventing air from flowing into the first conduit.

The valve assembly also includes a second mode of operation, in which a vacuum from the air box draws air through the venturi valve member and the housing of the check valve, placing the valve plate in an open position. In the second mode of operation, if the first conduit becomes disconnected from the air box, the venturi valve member and valve plate are no longer exposed to the vacuum from the air box, and the check valve moves to one of the closed positions.

There is a pressure drop across the venturi valve member during the first mode of operation and the second mode of operation, which creates a vacuum in the second conduit, drawing purge vapor from the second conduit into the venturi valve assembly.

A first inner surface is formed as part of the housing, and a second inner surface formed as part of the housing on the opposite side of the housing in relation to the first inner surface. A guide is located in the housing between the first inner surface and the second inner surface, and the valve plate is slidably mounted on the guide. A spring is located in between and in contact with the valve plate and the second inner surface, such that the spring biases the valve plate toward the first inner surface. During the first mode of operation, the pressurized air applies pressure to the valve plate in the opposite direction of the force applied to the valve plate from the spring, overcoming the force of the spring, such that the valve plate moves to the open position. The pressure balance provided by the flow restricting nozzle maintains the valve plate in the open position.

During the second mode of operation, the vacuum from the air box draws the valve plate toward the second inner surface, overcoming the force of the spring, and places the valve plate in the open position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a first diagram of an airflow system for a vehicle having a venturi valve assembly, according to embodiments of the present invention; and FIG. 2 is a diagram showing the correlation between a pressure chart and part of an airflow system for a vehicle having a venturi valve assembly, according to embodiments of the present invention.

DETAILED DESCRIPTION OF THE PREFERRED EMBODIMENTS

The following description of the preferred embodiment(s) is merely exemplary in nature and is in no way intended to limit the invention, its application, or uses.

A diagram of an airflow system of a vehicle having a turbo purge valve assembly according to the present invention is shown generally in FIG. 1 at 10. The system 10 includes an air box 12 which intakes air from the atmosphere. Located downstream of and in fluid communication with the air box 12 is a turbocharger unit 14, and located downstream of and in fluid communication with the turbocharger unit 14 is a throttle assembly 16. The throttle assembly 16 controls the amount of air flow into an intake manifold 18, which is part of an engine.

A plurality of conduits also provides fluid communication between the various components. Air flows through the conduits between the various components, and the direction of airflow through the conduits varies, depending on the mode of operation of each component. More specifically, there is a first conduit 20*a* providing fluid communication between the air box 12 and the turbocharger 14, a second conduit 20*b* providing fluid communication between the turbocharger 14 and the throttle assembly 16, and there is also a third conduit 20*c* providing fluid communication between the throttle assembly 16 and the intake manifold 18.

A fourth conduit 20*d* is in fluid communication with the third conduit 20*c* and a fifth conduit 20*e*, and the fifth conduit 20*e* places a turbo purge valve 22 in fluid communication with a venturi valve assembly 24. There is a first check valve 26 disposed in the fourth conduit 20*d*, and a second check valve 28 disposed in the fifth conduit 20*e*. There is also a carbon canister 30 in fluid communication with the turbo purge valve 22 through the use of a sixth conduit 20*f*.

A seventh conduit 20*g* provides fluid communication between the venturi valve assembly 24 and the second conduit 20*b*, such that pressurized air produced by the turbocharger 14 is able to flow from the second conduit 20*b*, through the seventh conduit 20*g* and to the venturi valve assembly 24. An eighth conduit 20*h* provides fluid communication between the venturi valve assembly 24 and the air box 12. The venturi valve assembly 24 includes venturi valve member 24*a* shown in FIG. 1 and a check valve 32, which is connected to the eighth conduit 20*h*.

Referring to the Figures generally, in operation, when the turbocharger 14 is not active, air flows through the air box 12, the turbocharger 14, the throttle 16, and into the intake manifold 18. The engine creates a vacuum drawing air into the intake manifold 18. This vacuum also causes the first check valve 26 to open, which draws purge vapor from the canister 30 through the turbo purge valve 22 (when the valve 22 is open), and into the intake manifold 18. This same vacuum pressure also causes the second check valve 28 to close.

When the turbocharger 14 is activated, air flowing into the turbocharger 14 from the air box 12 is pressurized, the pressurized air flows through the throttle 16, and the air then flows into the intake manifold 18. In this mode of operation, the manifold 18 is operating under positive pressure.

When the turbocharger 14 is activated, and pressurized air is passing through the seventh conduit 20*g*, the venturi valve member 24*a*, the check valve 32 (when the check valve 32 is in an open position), and the eighth conduit 20*h*, a vacuum is created and air is drawn from the fifth conduit 20*e* through venturi valve assembly 24, such that the air passes through the eighth conduit 20*h* and into the air box 12. This vacuum in the fifth conduit 20*e* also opens the second check valve 28, and purge vapor from the canister 30 passes through the turbo purge valve 22 (when the valve 22 is open), through the venturi valve 24*a*, the check valve 32, and into the air box 12. The purge vapor then flows through the turbocharger 14, the throttle 16, and into the intake manifold 18.

The check valve 32 includes a housing 36, where the venturi valve 24*a* is connected to the housing 36, and the eighth conduit 20*h* is also connected to the housing 36. Disposed in the housing 36 is also a valve plate 38 mounted on a guide 40. Also located within the housing 36 and at least partially surrounding the guide 40 is a biasing member, which in this embodiment is a spring 42. The spring 42 biases the valve plate 38 towards the venturi valve member 24*a* such that when air is not passing through the venturi valve member 24*a*, the spring 42 applies enough force to the valve plate 38 that the valve plate 38 contacts a first inner surface 44 of the housing 36, placing the valve 32 in a closed position.

There is a flow restricting nozzle 46 formed as part of the air box 12, as shown in FIG. 2. When the turbocharger 14 is generating pressurized air, the pressure from the air flow overcomes the force applied to the valve plate 38 by the spring 42, moving the valve plate 38 away from the first inner surface 44, and towards a second inner surface 48. The spring 42 is also in contact with the second inner surface 48 and the valve plate 38. The flow restricting nozzle 46 limits the amount of flow of air into the air box 12 from the eighth conduit 20*h*, allowing pressure to build in the eighth conduit 20*h*, creating a backpressure, which therefore creates a pressure balance around both sides of the valve plate 38. This pressure balance around the valve plate 38, along with the force applied to the valve plate 38 by the spring 42, maintains the valve plate 38 in an open position.

The valve plate 38 is considered to be in the open position when the valve plate 38 is not in contact with either the first inner surface 44 or the second inner surface 48, regardless of how close the valve plate 38 is to either surface 44, 48, because air is allowed to flow from the venturi valve member 24*a* and around the valve plate 38 in the housing 36 and into the eighth conduit 20*f*, even if there is a relatively small gap between the valve plate 38 and either of the surfaces 44, 48. The location of the valve plate 38 changes because the operation of the engine varies the level of pressurized air generated by the turbocharger 14 during the first mode of operation, and varies the level of vacuum from the air box 12 during the second mode of operation. This varies the air flow around the valve plate 38 in the housing 36.

The valve 32 also includes an automatic closing feature if the eighth conduit 20*h* were to ever become disconnected from the air box 12. The valve 32 has multiple closed positions, and in one of the closed positions, the valve plate 38 is in contact with the first inner surface 44, and in another of the closed positions, the valve plate 38 is in contact with the second inner surface 46. If the eighth conduit 20*h* is disconnected from the air box 12, due to the conduit 20*h* breaking or the like, the flow restricting nozzle 46 no longer functions to limit the air flow through the conduit 20*h*, thereby eliminating the back pressure and therefore the pressure balance around the valve plate 38. Under this condition, the pressurized air from the turbocharger 14 flowing through the venturi valve member 24*a* applies enough pressure to the valve plate 38 to overcome the force of the spring 42, moving the valve plate 38 away from the venturi valve member 24*a* and toward the second inner surface 48 such that the valve plate 38 contacts the second inner surface 48, placing the check valve 32 in a closed position.

This automatic closing feature provides several features. One of which is an on-board diagnostic (OBD) function, and another is the prevention of vapor from the canister 30 from entering into the atmosphere. When the turbocharger 14 is generating pressurized air, and purge vapor is passing through the purge valve 22, some level of vacuum should be detectable in the canister 30 by a pressure sensor 34. If the check valve 32 is closed because of the detachment of the eighth conduit 20*h* from the air box 12, the air in the eighth conduit 20*h* and the seventh conduit 20*g* remains pressurized, but because there is no air flow, the vacuum pressure in the fifth conduit 20*e* is eliminated, and the second check valve 28 moves to a closed position. If the turbocharger 14 is generating pressurized air, and the purge valve 22 is open, but there is no vacuum pressure in the fifth conduit 20*e* to open the second check valve 28 and allow the vapors from the canister 30 to flow through the valve 22, the pressure sensor 34 detects no pressure change in the canister 30, indicating that the system 10 has a malfunction. Also, because the check valve 32 is closed, the vapors (hydrocarbon rich air) in the canister 30 are prevented from venting to the atmosphere.

This is also shown in the chart, shown generally at 50 in FIG. 2, where the first line 52 indicates different pressure levels along the venturi valve member 24*a*, the check valve 32, and the eighth conduit 20*h*, when the eighth conduit 20*h* is connected to the air box 12. The chart 50 also includes a second line 54 which indicates different pressure levels along the venturi valve member 24*a*, the check valve 32, and the eighth conduit 20*h*, when the eighth conduit 20*h* is disconnected from the air box 12.

The first line 52 has a first zone 56 which shows the pressure drop across the venturi valve member 24*a*. A portion of this zone 56 has negative pressure, which indicates the vacuum pressure used to draw the purge vapor into the venturi valve assembly 24 from the fifth conduit 20*e*. The first line 52 also has a second zone 58, which shows the small difference in pressure on each side of the valve plate 38, and when the force of the spring 42 is combined with the air pressure on each side of the valve plate 38, the above-mentioned pressure balance on each side of the valve plate 38 is achieved, maintaining the valve plate 38 in the open position, as shown in FIG. 2. The first line 52 also includes a third zone 60, which shows a small pressure drop through the eighth conduit 20*h*, and a fourth zone 62 which shows the pressure drop to zero pressure once the air reaches the air box 12 after passing through the flow restricting nozzle 46.

The second line 54 has three zones, the first zone 64 which indicates the pressure along the venturi valve member 24*a*, a second zone 66 showing the pressure drop across the check valve 32, and a third zone 68 indicating little or no pressure in the eighth conduit 20*h*. The three zones 64, 66, 68 of the second line 54 indicate the pressure levels when the eighth conduit 20*h* is disconnected from the air box 12, and the check valve 32 is in a closed position. This pressure level in the first zone 64 is constant, because the check valve 32 is in a closed position, and the valve plate 38 is in contact with the second inner surface 48. The second zone 66 shows the pressure change across the check valve 32, where one side of the valve plate 38 is exposed to the pressurized air generated by the turbocharger 14 flowing through the venturi valve member 24*a*, and the other side of the valve plate 38 receives force from the spring 42, but because there is no pressure in the eighth conduit 20*h* (due to the eighth conduit 20*h* being detached from the air box 12), there is little to no pressure on the other side of the valve plate 38, as indicated by the decrease in the second line 54 in the second zone 66. The third zone 68 of the second line 54 indicates little or no pressure in the eighth conduit 20*h*; this occurs because the eighth conduit 20*h* being disconnected from the air box 12, and therefore the flow restricting nozzle 46 doesn't provide flow restriction of the pressurized air, producing little to no pressure in the eighth conduit 20*h*.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus, comprising:

a valve assembly, including:

a venturi valve member;

a valve connected to the venturi valve member, the valve being movable between an open position, and one of a plurality of closed positions;

an air box; and a first conduit in fluid communication with and connected to the valve and the air box;

wherein the venturi valve member and the valve function in at least two modes of operation, such that in the first mode of operation, pressurized air flows from the venturi valve member and through the valve, the first conduit, and into the air box, and the valve is exposed to back pressure such that the valve is placed in the open position, and in a second mode of operation, vacuum draws air from the valve and the venturi member, placing the valve in the open position, allowing the air to pass through the first conduit and into the air box, and during the second mode of operation, the valve changes to one of the plurality of closed positions when the first conduit becomes detached from the air box, and the valve is no longer exposed to the vacuum.

2. The apparatus of claim 1, the valve being a check valve, further comprising:

a housing connected to the venturi valve member, the first conduit connected to the housing;

a valve plate disposed in the housing, the valve plate moveable between the open position and one of the plurality of closed positions; and a spring connected to the valve plate and the housing such that the spring biases the valve plate towards the venturi valve member;

wherein during the first mode of operation, the pressurized air flows through the venturi valve member into the housing, and applies pressure to the valve plate such that the force applied to the valve plate from the spring is overcome, and a back pressure is generated in the first conduit and applied to the valve plate such that a pressure balance around the valve plate is achieved, maintaining the check valve in the open position.

3. The apparatus of claim 2, wherein during the first mode of operation, and the first conduit is detached from the air box, the back pressure is removed from the valve plate, and the pressurized air applies force to the valve plate, and the check valve changes to one of the plurality of closed positions.

4. The valve assembly for an air flow system of claim 2, wherein during the second mode of operation, a vacuum from the air box draws air through the venturi valve member and the check valve, placing the check valve in the open position such that if the first conduit becomes disconnected from the air box, the venturi valve member and check valve are no longer exposed to the vacuum from the air box, and the check valve moves to one of the plurality of closed positions.

5. The apparatus of claim 2, further comprising:

a first inner surface formed as part of the housing;

a second inner surface formed as part of the housing; and a guide located in the housing between the first inner surface and the second inner surface, the valve plate being slidably mounted on the guide;

wherein the spring biases the valve plate toward the first inner surface, and in the first mode of operation, the pressurized air applies force to the valve plate to overcome the force applied to the valve plate by the spring, placing the check valve in the open position, and in the second mode of operation, the vacuum overcomes the force applied to the valve plate by the spring, placing the check valve in the open position.

6. The apparatus of claim 5, wherein during the first mode of operation and the first conduit becomes detached from the air box, the pressurized air in the check valve applies pressure to the valve plate such that the force of the spring is overcome, and the valve plate moves towards and contacts the second inner surface, placing the check valve in one of the plurality of closed positions.

7. The apparatus of claim 5, wherein during the second mode of operation, and the first conduit becomes detached from the air box, the vacuum is removed from the check valve and the venturi valve member, and the force from the spring moves the valve plate toward and contacts the first inner surface, placing the check valve in one of the plurality of closed positions.

8. The apparatus of claim 1, further comprising:

a flow restricting nozzle formed as part of the air box;

wherein the flow restricting nozzle generates the back pressure in the first conduit and the valve such that when the first conduit is detached from the air box, and the valve assembly is in the first mode of operation, the pressure balance in the valve is removed, and the valve changes from the open position to one of the plurality of closed positions.

9. The apparatus of claim 1, further comprising a second conduit connected to the venturi valve member such that purge vapor is drawn from the second conduit into the venturi valve member and mixed with the pressurized air in the first mode of operation, and in the second mode of operation the vacuum drawing air from the venturi valve assembly draws the purge vapor from the second conduit into the venturi valve member such that the purge vapor is mixed with the air in the venturi valve member.

10. The valve assembly of claim 9, further comprising a pressure drop across the venturi valve member during the first mode of operation and the second mode of operation, wherein the pressure drop across the venturi valve member creates a vacuum in the second conduit, drawing purge vapor from the second conduit into the venturi valve assembly.

11. A valve assembly for an air flow system having multiple modes of operation, comprising:

a venturi valve member;

a check valve connected to the venturi valve member;

an air box;

a first conduit in fluid communication with and connected to the check valve and the air box;

a flow restricting nozzle formed as part of the air box; and a second conduit in fluid communication with the venturi valve member;

wherein in a first mode of operation, pressurized air flows from the venturi valve member through the check valve, placing the check valve in an open position, allowing the pressurized air to flow through the check valve, and the check valve remains in the open position because of a pressure balance around the check valve created by the back pressure generated by the flow restricting nozzle such that when the first conduit becomes disconnected from the air box, the pressure balance around the check valve is removed, and the pressurized air flowing from the venturi nozzle flows into the check valve and places the check valve in one of a plurality of closed positions, preventing air from flowing into the first conduit.

12. The valve assembly for an air flow system of claim 11, further comprising a second mode of operation, where a vacuum from the air box draws air through the venturi valve member and the check valve, placing the check valve in the open position such that if the first conduit becomes disconnected from the air box, the venturi valve member and check valve are no longer exposed to the vacuum from the air box, and the check valve moves to one of the plurality of closed positions.

13. The valve assembly for an air flow system of claim 11, the check valve further comprising:

a housing connected to the venturi valve member;

a first inner surface formed as part of the housing;

a second inner surface formed as part of the housing;

a guide located in the housing between the first inner surface and the second inner surface;

a valve plate slidably mounted on the guide; and a spring connected to the valve plate, such that the spring is located between the valve plate and the second inner surface;

wherein during the first mode of operation, the pressurized air applies pressure to the valve plate, overcoming the force of the spring, such that the valve plate moves to the open position, and the pressure balance provided by the flow restricting nozzle maintains the valve plate in the open position, and during the second mode of operation, the vacuum from the air box draws the valve plate toward the second inner surface, overcoming the force of the spring, and places the valve plate in the open position.

14. The valve assembly of claim 13, wherein during the first mode of operation, and the first conduit becomes disconnected from the air box, the pressure balance provided by the flow restricting nozzle is removed, and the pressurized air flowing from the venturi valve member applies pressure to the valve plate, overcoming the force applied to the valve plate by the spring, placing the valve plate in contact with the second inner surface such that the check valve is in one of the plurality of closed positions.

15. The valve assembly of claim 13, wherein during the second mode of operation, and the first conduit becomes disconnected from the air box, the vacuum pressure in the venturi valve member and the check valve is removed, and the spring moves the valve plate such that the valve plate contacts the first inner surface, placing the check valve in one of the plurality of closed positions.

16. The valve assembly of claim 11, further comprising a pressure drop across the venturi valve member during the first mode of operation and the second mode of operation, the pressure drop across the venturi valve member creates a vacuum in the second conduit, drawing purge vapor from the second conduit into the venturi valve assembly.

17. A valve assembly, comprising:

a venturi valve member;

a check valve connected to the venturi valve member;

an air box;

a first conduit in fluid communication with and connected to the air box;

a housing being part of the check valve, the housing connected to and in fluid communication with the first conduit and the venturi valve member;

a valve plate moveably disposed in the housing, the valve plate moveable between at least one closed position and an open position;

a flow restricting nozzle formed as part of the air box; and a second conduit in fluid communication with the venturi valve member;

wherein in a first mode of operation, pressurized air flows from the venturi valve member through the housing of the check valve, applying pressure to the valve place such that the valve plate moves to the open position, allowing the pressurized air to flow through the check valve, and the check valve remains in the open position because of a pressure balance around the valve plate created by the back pressure generated by the flow restricting nozzle such that when the first conduit becomes disconnected from the air box, the pressure balance around the valve plate is removed, and the pressurized air flowing from the venturi nozzle flows into the housing and places the check valve in the at least one closed position, preventing air from flowing into the first conduit.

18. The valve assembly of claim 17, further comprising a second mode of operation, vacuum from the air box draws air through the venturi valve member and the housing of the check valve, placing the valve plate in the open position such that if the first conduit becomes disconnected from the air box, the venturi valve member and valve plate are no longer exposed to the vacuum from the air box, and the check valve moves to the at least one closed position.

19. The valve assembly of claim 17, further comprising:

a first inner surface formed as part of the housing;

a second inner surface formed as part of the housing on the opposite side of the housing in relation to the first inner surface;

a guide located in the housing between the first inner surface and the second inner surface, the valve plate slidably mounted on the guide; and a spring located in between and in contact with the valve plate and the second inner surface, such that the spring biases the valve plate toward the first inner surface;

wherein during the first mode of operation, the pressurized air applies pressure to the valve plate in the opposite direction of the force applied to the valve plate from the spring, overcoming the force of the spring, such that the valve plate moves to the open position, and the pressure balance provided by the flow restricting nozzle maintains the valve plate in the open position, and during the second mode of operation, the vacuum from the air box draws the valve plate toward the second inner surface, overcoming the force of the spring, and places the valve plate in the open position.

20. The valve assembly of claim 17, further comprising a pressure drop across the venturi valve member during the first mode of operation and the second mode of operation, the pressure drop across the venturi valve member creates a vacuum in the second conduit, drawing purge vapor from the second conduit into the venturi valve assembly.

* * * * *